US010297960B2

(12) United States Patent
Urtz, Jr.

(10) Patent No.: US 10,297,960 B2
(45) Date of Patent: May 21, 2019

(54) CURRENT INHIBITING RF CONNECTOR FOR COAXIAL/JUMPER CABLES

(71) Applicant: John Mezzalingua Associates, LLC, Liverpool, NY (US)

(72) Inventor: Thomas S. Urtz, Jr., North Syracuse, NY (US)

(73) Assignee: John Mezzalingua Associates, LLC, Liverpool, NY (US)

( * ) Notice: Subject to any disclaimer, the term of this patent is extended or adjusted under 35 U.S.C. 154(b) by 0 days.

(21) Appl. No.: 15/874,386

(22) Filed: Jan. 18, 2018

(65) Prior Publication Data

US 2018/0226757 A1 Aug. 9, 2018

Related U.S. Application Data

(60) Provisional application No. 62/448,679, filed on Jan. 20, 2017.

(51) Int. Cl.

| | |
|---|---|
| ***H01R 24/54*** | (2011.01) |
| ***H01R 24/42*** | (2011.01) |
| ***H01R 13/52*** | (2006.01) |
| ***H01P 1/26*** | (2006.01) |
| *H01R 13/623* | (2006.01) |

(52) U.S. Cl.

CPC ..... *H01R 24/542* (2013.01); *H01P 1/266* (2013.01); *H01R 13/5213* (2013.01); *H01R 24/42* (2013.01); *H01R 13/5202* (2013.01); *H01R 13/623* (2013.01)

(58) Field of Classification Search

CPC .. H01R 24/542; H01R 24/42; H01R 13/5213; H01R 13/5202; H01R 13/623

USPC ..... 439/507, 578–594

See application file for complete search history.

(56) References Cited

U.S. PATENT DOCUMENTS

| | | | | |
|---|---|---|---|---|
| 6,027,373 | A * | 2/2000 | Gray | H01R 4/489 174/74 R |
| 7,275,957 | B1 * | 10/2007 | Wlos | H01R 9/0527 439/583 |
| 7,455,550 | B1 * | 11/2008 | Sykes | H01R 13/506 439/578 |
| 7,527,512 | B2 * | 5/2009 | Montena | H01R 24/564 29/861 |
| 7,670,182 | B2 * | 3/2010 | Morikawa | H01R 9/0518 439/620.03 |
| 8,177,583 | B2 * | 5/2012 | Chawgo | H01R 9/0524 439/584 |
| 8,419,464 | B2 * | 4/2013 | Montena | H01R 24/42 439/489 |
| 9,419,331 | B1 * | 8/2016 | Kraige | H01Q 1/40 |

(Continued)

*Primary Examiner* — Harshad C Patel

(74) *Attorney, Agent, or Firm* — Barclay Damon LLP

(57) ABSTRACT

A connector for coupling a coaxial cable to an interface port comprising a capacitor segment configured to interpose a center conductor of a coaxial cable and an RF interface and an outer conductor segment extending over and electrically shielding the capacitor segment. The capacitor segment comprises an inner and outer pin having a dielectric insulator therebetween and is configured to electrically connect an inner conductor of the coaxial cable to the RF interface port. The capacitor segment facilitates the passage of RF energy from the inner conductor of the coaxial cable to the RF interface while inhibiting the passage of electric current through the capacitor segment to the RF interface.

18 Claims, 6 Drawing Sheets

(56) References Cited

U.S. PATENT DOCUMENTS

| | | | | |
|---|---|---|---|---|
| 2008/0164055 | A1* | 7/2008 | Wang | G06F 1/189<br>174/260 |
| 2008/0318470 | A1* | 12/2008 | Morikawa | H01R 9/0518<br>439/578 |
| 2011/0034072 | A1* | 2/2011 | Feldman | H01R 9/0512<br>439/578 |
| 2014/0273622 | A1* | 9/2014 | Tagan | H01R 9/0521<br>439/578 |
| 2016/0013597 | A1* | 1/2016 | Huang | H01R 13/6683<br>439/620.21 |

* cited by examiner

CURRENT INHIBITING RF CONNECTOR FOR COAXIAL/JUMPER CABLES

CROSS-REFERENCE TO RELATED APPLICATIONS

This application is a non-provisional patent application of, and claims the benefit and priority of, U.S. Provisional Patent Application No. 62/448,679 filed on Jan. 20, 2017. The entire contents of such application is hereby incorporated by reference.

TECHNICAL FIELD

The present disclosure relates to Radio Frequency (RF) jumper cables for use with macro cellular antennas, and, more particularly, to a jumper cable having an integrated direct current power block in combination with an end connector. The jumpers have very stringent performance requirements and are exposed to potentially severe weather.

BACKGROUND

A market exists for individual components intended to block the DC power transmitted through a coaxial cable from entering equipment interface ports, while still allowing a range of RF frequencies to pass through. This is done for any number of reasons, most of which are some manifestation of surge protection or preventing residual power in the transmission line from interfering with the active components of the system.

The current method for protecting equipment from DC power involves attaching a long, bulky interstitial component between the cable connector and the interface port. Conventional solutions involve interposing an additional separate DC Block between the coaxial cable and the equipment interface port. This results in several problems: first, a separate DC block introduces an additional point of connection, which could fail; second, installation is complicated by the need to provide and install an additional DC Block component; and third, the external geometry of the DC block may vary, depending on the model and manufacturer, which greatly complicates the weather protection required for mitigating the infiltration of water and ice into the cable connector and separate DC Block assembly.

Therefore, there is a need to overcome, or otherwise lessen the effects of, the disadvantages and shortcomings described above.

BRIEF DESCRIPTION OF THE DRAWINGS

Additional features and advantages of the present disclosure are described in, and will be apparent from, the following Brief Description of the Drawings and Detailed Description.

SUMMARY OF THE INVENTION

Figure 1:
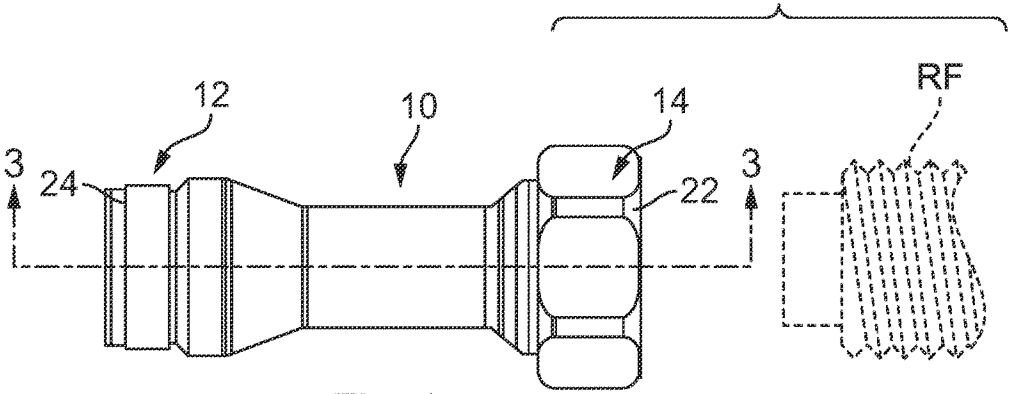
FIG. 1 is a profile view of a current-inhibiting, or DC blocking, Radio Frequency (RF) connector in accordance with an embodiment of the disclosure wherein the connector is configured to inhibit the flow of direct current while facilitating the transmission of RF signals.

In one embodiment, a connector is provided for coupling a coaxial cable to an interface port, comprising a capacitor segment interposing a center conductor of a coaxial cable to a center conductor of an interface port and an outer conductor segment extending over and electrically shielding the capacitor segment. The capacitor segment comprises an inner and outer pin having a dielectric insulator therebetween and is configured to electrically connect an inner conductor of the coaxial cable to the interface port thereby facilitating the passage of RF energy from the inner conductor of the coaxial cable to the interface port while inhibiting the passage of electric current through the capacitor segment to the interface port.

In another embodiment, an RF jumper cable is provided comprising a coaxial cable having a center conductor and an outer conductor, a coupling member configured to mechanically and electrically coupling the outer conductor of the coaxial cable to an outer conductor of an interface port, and a capacitor segment interposing the coaxial cable and electrically connecting the center conductor of the coaxial cable to an inner conductor of the interface port. The capacitor segment is disposed internally of, and coaxial with, the outer conductor of the coaxial cable and comprises an inner pin coupled to the center conductor of the coaxial cable, a concentric outer pin connecting to an inner conductor of the interface port, a dielectric insulator interposing the inner pin and the outer pin, and a conductive outer body segment disposed over the concentric outer pin of the capacitor segment. The conductive outer body segment interposes the outer connector and the male connector and electrically connects the outer conductor of the coaxial cable to the interface port through the coupling member. The capacitor segment is electrically shielded by the conductive outer body segment, facilitates the passage of RF signals to and from the interface port and inhibits the passage of electrical current to/from the interface port and/or the coaxial cable.

DETAILED DESCRIPTION

The present disclosure is directed to an RF jumper cable including a connector having an integrated current inhibitor or DC Block. The disclosure describes a robust jumper cable/connector/capacitor having a significantly reduced design envelope. Further, the present disclosure integrates an organic or electrolytic capacitor to reduce the overall size, cost, and complexity of the jumper cable and the cooperating components. While the connector/capacitor is described in the context of a jumper cable, it will be appreciated that the connector is applicable to any cable connection requiring the transmission of RF signals to and/or from an interface port.

Additionally, the present disclosure employs a laser welded jumper platform. A laser welded jumper of the type employed is disclosed in commonly-owned, co-pending patent application Ser. No. 14/812,227 entitled "Coaxial Cable Device Having A Helical Outer Conductor and Method for Effecting Weld Connectivity," the contents of which are incorporated herein by reference in their entirety.

Figure 2:
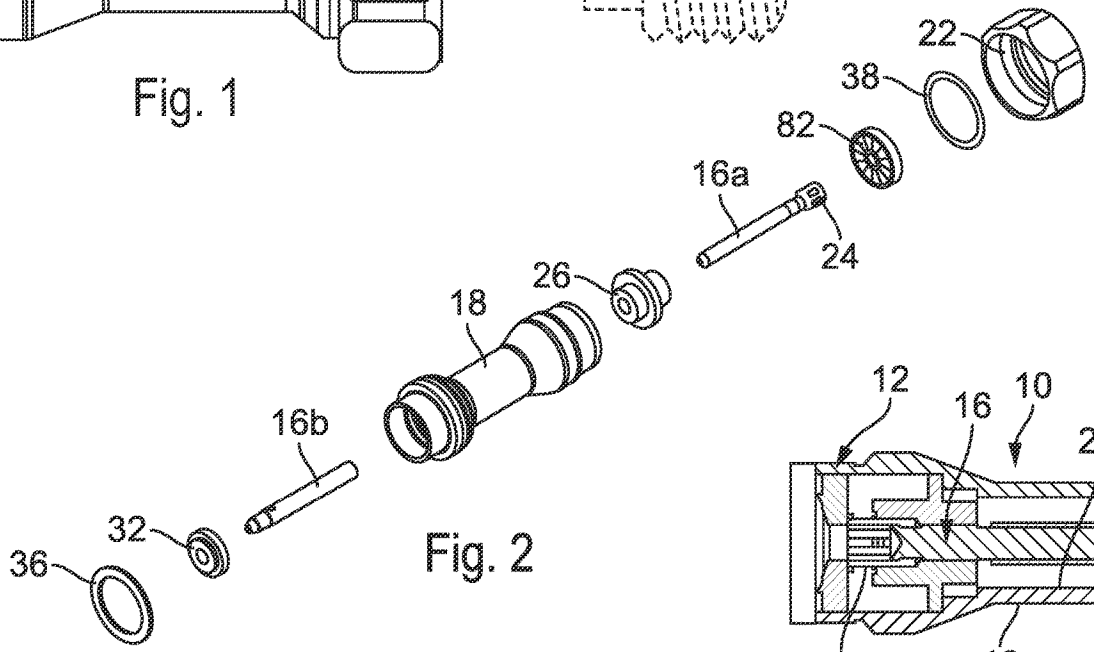
FIG. 2 is an exploded view of the current-inhibiting RF connector depicted in FIG. 1.
Figure 3:
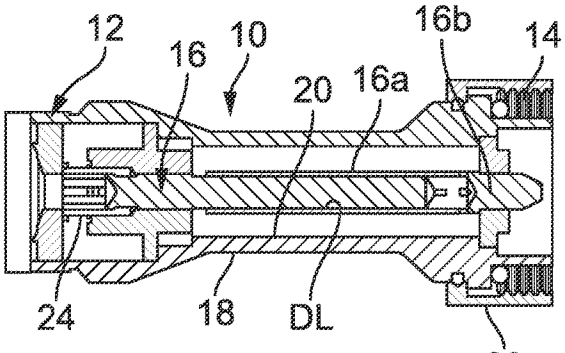
FIG. 3 is sectional view taken substantially along line 3-3 of FIG. 1.
Figure 5:
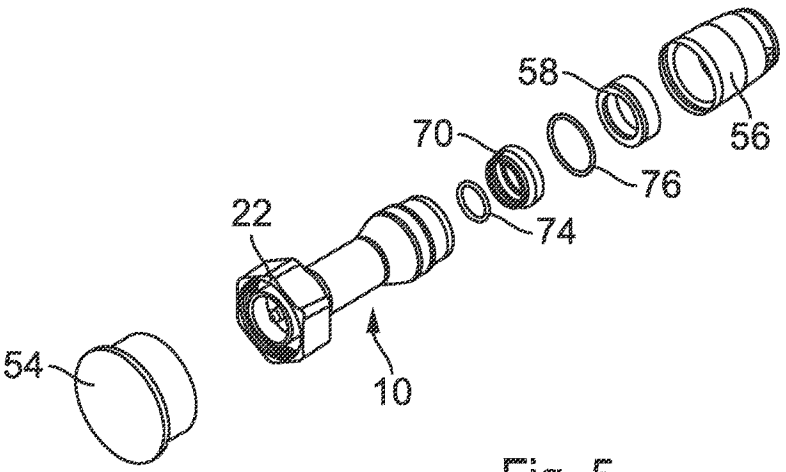
FIG. 5 is an exploded view of the current-inhibiting RF connector depicting forward and aft end-caps for inhibiting the ingress of moisture and/or debris into the connector.
Figure 6:
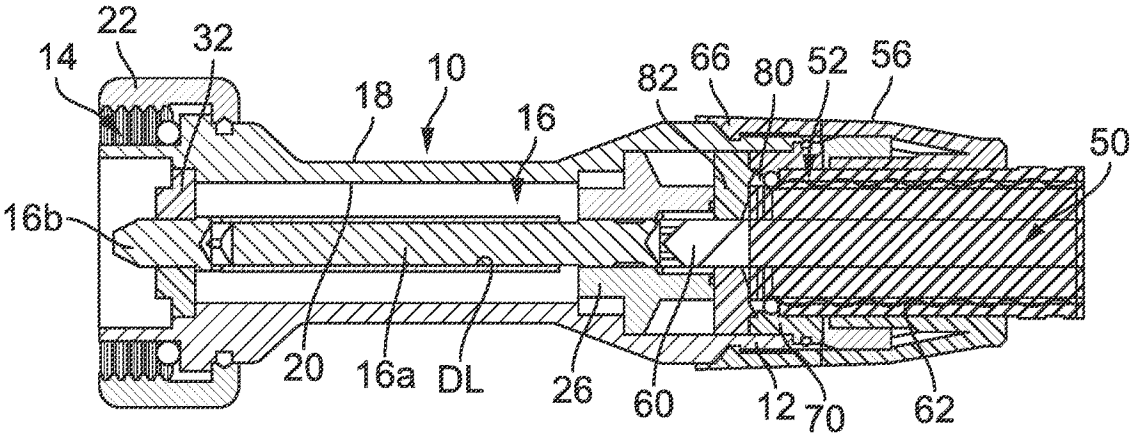
FIG. 6 is a cross-sectional view of the current-inhibiting RF connector taken substantially along line 6-6 of FIG. 4.
Figure 7:
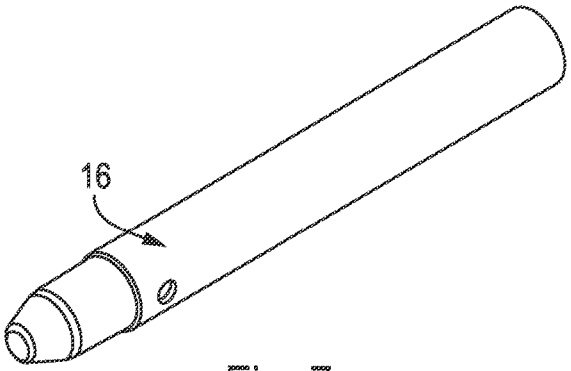
FIG. 7 depicts an isolated perspective view of a capacitor segment of the RF connector including an inner and outer pin which function to develop a static charge therein to prevent the free flow of electrons across a gap between the inner and outer pins.
Figure 8:
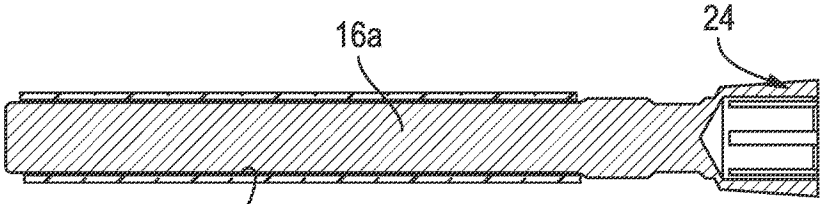
FIG. 8 is a sectional view of the inner pin of the capacitor segment including a dielectric insulator disposed over a portion of the inner pin.
Figure 9:
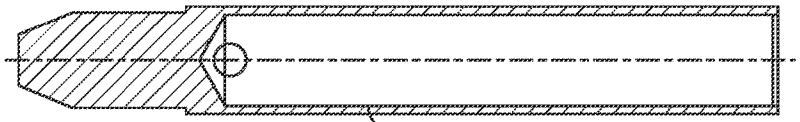
FIG. 9 is a sectional view of the outer pin of the capacitor segment.
Figure 10:
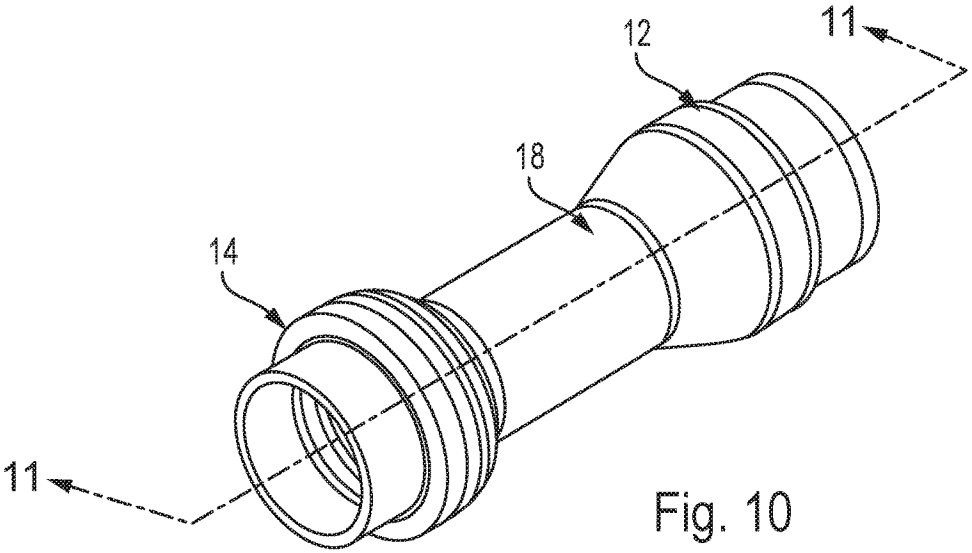
FIG. 10 is an isolated perspective view of a conductive outer body segment of the RF connector including a central bore for accepting the capacitor segment.
Figure 11:
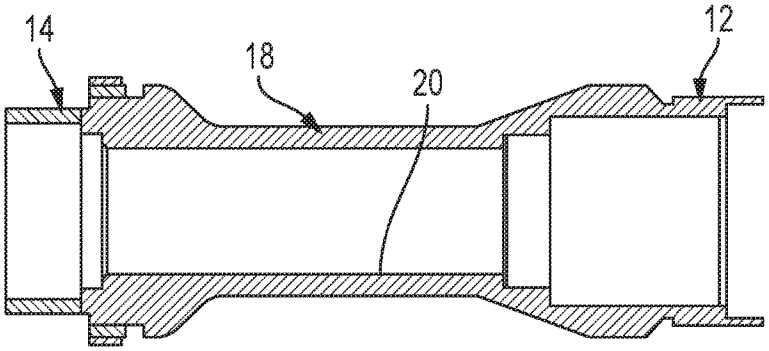
FIG. 11 is a cross-sectional view taken substantially along line 11-11 of FIG. 10.

In FIGS. 1-11, a current inhibitor is integrated with, and interposed between, a coaxial cable 50 (FIG. 6) and an Radio Frequency (RF) interface or interface port RF to produce a current inhibiting Radio Frequency (RF) connector/capacitor 10 (hereinafter simply "the RF connector"). A first end 12 of the RF connector 10 (FIG. 1) is configured to be disposed in combination with a prepared end of a helical or corrugated outer conductor while a second end 14 is configured to be coupled to an interface port. In FIGS. 2, 3 and 6, the novel RF connector 10 includes a capacitor segment 16 (FIG. 3) and a conductive outer body segment 18. In FIGS. 2, 7-9, the capacitor segment 16 includes an inner pin 16*a*, an outer pin 16*b* which are concentrically arranged. The outer ping 16*b* is disposed over at least a portion of the inner pin 16*a*, and an insulator or dielectric coating, layer, or filler material DL (best seen in FIG. 8) interposes at least a portion of the inner and outer pins 16*a*, 16*b*.

The insulator DL may be any material having low or non-conductive properties. In the described embodiment, a layer of Kapton® (Kapton is a registered Trademark of DowDupont located in Wilmington, State of Delaware) tape is disposed between the inner and outer pins 16*a*, 16*b* creating a dielectric break between the pins 16*a*, 16*b* to produce the capacitor segment 16. Kapton is a polyimide film and its chemical composition is poly-oxydiphenylene-pyromellitimide. In the described embodiment, the Kapton tape is disposed over the inner conductor 16*a* for a length of between about 1.5 inches to about 2.3 inches. The Kapton tape forms a relatively thin layer of insulating material between the inner and outer pins 16*a*, 16*b* and, in the described embodiment, produces a thickness of between about 0.045 inches to about 0.020 inches.

Variations of the insulator DL are contemplated within the scope of the present disclosure. For example, the capacitor does not need to be a single coaxial capacitor. The same effect could be achieved using a plurality of coaxial conductors each having a dielectric material therebetween. Further, the capacitor segment 16 may be an electrolytic capacitor wherein the dielectric coating, layer or filler material DL is comprised of a hard ceramic material. In this instance, the dielectric ceramic layer DL may be etched onto the inner pin 16*a* of the capacitor segment 16. An electrolytic capacitor segment 16 produces a significantly higher dielectric constant, enabling far smaller, i.e., shorter, pins 16*a*, 16. For example, to achieve a desired bandpass property, a capacitor employing a Kapton layer DL, having a mean thickness of about 0.034 inches, may have an overlapping portion of 1.5 inches in length. A similar structure employing a ceramic dielectric, i.e., a ceramic layer having the same thickness, may require an overlapping portion having a length of 0.75" for the same performance. Accordingly, the ceramic dielectric may be ½ of the length of a Kapton insulator.

In FIGS. 2, 3, 6, 10 and 11, the capacitor segment 16 functionally supplants, or substitutes for, the inner conductor 60 of the coaxial cable 50, i.e., the structure which transmits RF signals across the RF connector 10 from a prepared end 52 (FIG. 6) of the cable 50 to an interface port. The conductive outer body segment 18 includes a central bore 20 for receiving and circumscribing the capacitor segment 16. More specifically, the conductive outer body segment 18 is disposed over, circumscribes, and produces an electrical shield over the capacitor segment 16. With respect to the latter, the electrical shield is produced by grounding the outer body segment 18 to the interface port via a coupling member 22 at the second end 14 of the outer body segment 18. The first end 12 of the outer body segment 18 is grounded to a spiral helical outer conductor of a coaxial cable through a penetration welded split washer such as that described in commonly-owned, co-pending patent application Ser. No. 14/812,227. It will be appreciated that the outer body segment 18 may include male or female threads at one of the ends 12, 14 and a rotatable nut or coupling member 22 at the other of the ends 12, 14 to produce a continuous shielding element over the capacitor segment 16.

In FIGS. 2, 3, 7-9, the strength of the capacitor segment 16 is determined by a region of overlap between the outer and inner pins 16*a*, 16*b*. In one embodiment, the capacitor 16 produces a region OL of overlap ranging from about 0.2 inches to about 2.3 inches and in another embodiment, the region OL of overlap is smaller and ranges from about 0.75 inches to about 1.5 inches. In the illustrated embodiment, the inner pin 16*a* forms a socket 24 at one end while the outer pin 16*b* forms a tapered end for being received within a socket (not shown) or receptacle of the interface port. The socket 24 may include a plurality of inwardly-biased fingers to frictionally engage the tip end of a coaxial cable center conductor upon being axially pressed or urged into the socket 24. Alternatively, a variety of other contact configurations may be employed to releasably detach the inner and outer pins 16*a*, 16*b* of the capacitor segment 16 from the coaxial cable 50 and from the interface port.

In the described embodiment, the end of the inner pin 16*a* is centered within and supported by a first centering member 26 disposed within the central bore 20 (see FIGS. 2 and 3) of the conductive outer body segment 18. This centering member 26 receives the inner pin 16*a* immediately forward of the socket 24. Similarly, an end of the outer pin 16*b* is supported by a second centering member 32 which is also supported within the bore 20. Finally, a void or region AR of insulating air is produced between the capacitor segment 16 and the conductive outer body segment 18. This region AR may be sealed by a pair of O-ring sealing elements 36, 38 disposed in combination with each of the first and second centering members 26, 32. While, in the described embodiment, the region AR is filled with air, it will be appreciated that other insulating elements or materials may fill the region AR. For example, a low density foam, or inert gas such as helium or argon may fill the region to prevent the arcing of electrical signals or current across the region. Accordingly, the outer body segment 18, protects, seals, grounds, and electrically shields the inner capacitor segment 16 of the current inhibiting RF connector 10.

Figure 4:
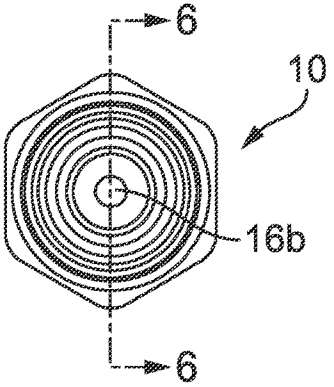
FIG. 4 is an end view of the current-inhibiting RF connector.

In FIGS. 4, 5 and 6, an end 50 of a coaxial cable 52 is prepared in accordance with the welding techniques of a "Method for Effecting Weld Connectivity" disclosed in Ser. No. 14/812,227. As can be seen in FIGS. 5 and 6, weather protecting end caps 54, 56 and 58 may be disposed at each end of the current inhibiting RF connector 10. At an outboard or forward end, a conventional plastic cap 54 (FIG. 5) plugs the coupling member 22 of the RF connector 10. At an inboard end, an annular cap 56 is disposed over the corrugated outer conductor 62 and receives an annular ring 58 (FIG. 5) which is disposed between a V-shaped portion of the annular cap 56 to impose a compressive sealing force against the exterior of the coaxial cable. An inboard end 66 of the annular cap 56 snaps into engagement with a corresponding groove formed in the first end 12 of the outer body segment 18.

A weld ring 70 is disposed over the end of the cable 50 and receives inner and outer O-ring seals 74, 76, respectively to prevent moisture and debris from entering the outer body segment 18, on one side thereof, and the coaxial cable 50, on the other side thereof. A conductive split ring 80 is penetration welded to the weld ring 70 to provide an electrical ground path from the conductive corrugated outer conductor 62 to the weld ring 70. Inasmuch as the weld ring 70 interposes the outer conductor 62 and the first end 12 of the outer body segment 18, an electrical ground path is produced from the outer conductor 62 to the outer body segment 18.

Figure 14:
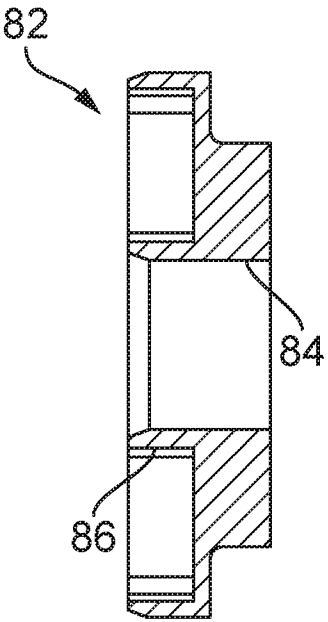
FIG. 14 is a sectional view taken substantially along line 14-14 of FIG. 13.
Figure 13:
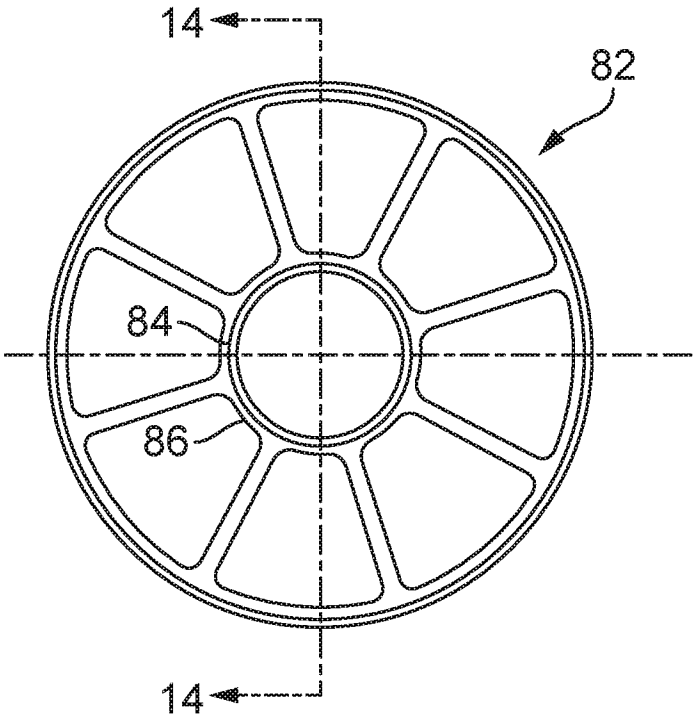
FIG. 13 is an isolated plan view of a spoked ring for centering the capacitor segment within the conductive outer body segment.

In FIGS. 6, 13 and 14 the inner conductor 60, which transmits the RF signal along the coaxial cable 50, is centered by a spoked wheel or ring 82 which is disposed, in an axial direction, between the weld ring 70 and the centering member 26 of the capacitor segment 16. That is, the inner conductor 60 is received by an aperture 84 in a hub portion 86 of the spoked ring 82 to direct the inner conductor pin 60 into the socket 24 of the capacitor segment 16.

Figure 12:
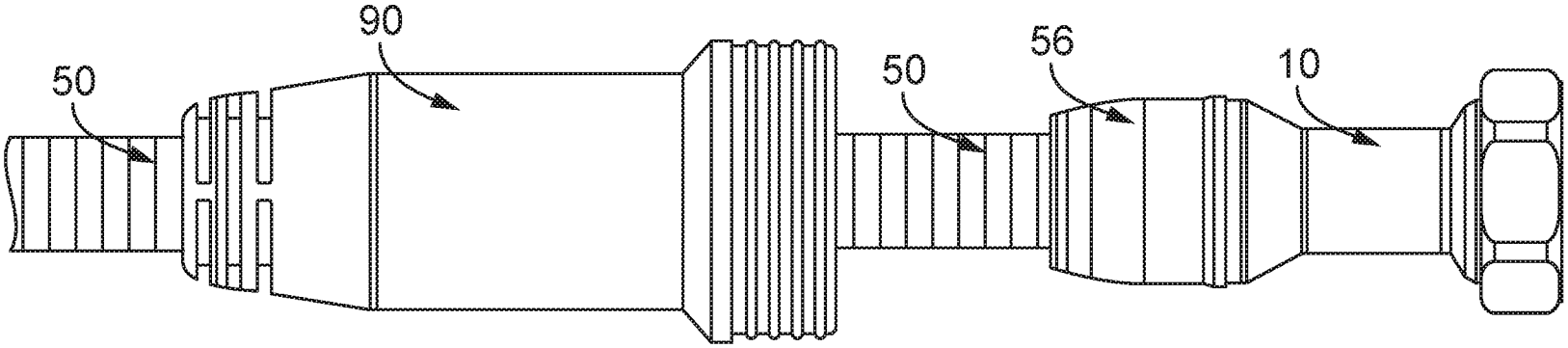
FIG. 12 is an end view of a jumper cable including the novel current inhibiting RF connector and a weather protecting sleeve slideably engaging the outer body segment upon installation.

Finally, in FIG. 12, an end view of a jumper cable is depicted including the novel current inhibiting RF connector 10. Inasmuch as the current inhibiting RF connector 10 of the disclosure produces a streamlined outer diameter, i.e., similar to current RF connectors, a conventional weather protecting sleeve 90 may be employed to slideably engage the outer body segment 18 of the RF connector 10.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A connector for coupling a coaxial cable to a Radio Frequency (RF) interface, comprising:

a capacitor segment including an inner pin, an outer pin coaxially aligned with the inner pin and disposed over at least a portion of the inner pin, and an insulator disposed between at least a portion of the inner pin and the outer pin, the inner and outer pins defining an overlapping region between about 1.5 inches to about 2.3 inches in length and the insulator defining a thickness dimension of between about 0.020 inches to about 0.045 inches and a conductive outer body segment disposed over and fully enveloping the capacitor segment to electrically shield the capacitor segment;

wherein the capacitor segment is configured to interpose and electrically connect an inner conductor of the coaxial cable and the RF interface thereby facilitating the passage of RF energy from the inner conductor of the coaxial cable to the RF interface while inhibiting the passage of electric current through the capacitor segment to the RF interface.

2. The connector of claim 1, configured to be coupled to a jumper cable for transmitting the RF energy of a telecommunications device.

3. The connector of claim 1, wherein the insulator comprises an organic dielectric.

4. The connector of claim 1, wherein the insulator comprises a polyimide film.

5. The connector of claim 1, wherein the insulator comprises a ceramic material.

6. The connector of claim 1, wherein the overlapping region is between about 0.75 inches to about 1.50 inches in length.

7. The connector of claim 1, further comprising a weatherproofing boot, concentric with a coaxial cable, and configured to slide over the coaxial cable to cover the conductive outer body segment.

8. The connector of claim 1, wherein the inner pin comprises a socket portion at one end that engages the inner conductor of the coaxial cable.

9. The connector of claim 8, wherein the socket portion of the inner pin is not disposed within an overlapping region.

10. The connector of claim 1, further comprising an air gap between the outer pin and an internal surface of the conductive outer body segment.

11. The connector of claim 1, further comprising an end connector segment configured to electrically and mechanically couple the capacitor segment and the outer body segment to the RF interface.

12. An RF jumper cable comprising:

a coaxial cable segment;

a capacitor segment coupled to the coaxial cable segment, the capacitor segment including an inner pin coupled to an inner conductor of the coaxial cable segment, an outer pin coaxially aligned with the inner pin and disposed over at least a portion of the inner pin, an insulator disposed between at least a portion of the inner pin and the outer pin, and a conductive outer body segment, the inner and outer pins defining an overlapping region between about 1.5 inches to about 2.3 inches in length and the insulator defining a thickness dimension of between about 0.020 inches to about 0.045 inches, the conductive outer body segment disposed over and fully enveloping the capacitor segment to electrically shield the capacitor segment; and a coupling member disposed on an end of the capacitor segment opposite the coaxial cable segment, wherein the capacitor segment is configured to electrically connect an inner conductor of the coaxial cable segment to an RF interface to facilitate the passage of RF energy through the capacitor segment while inhibiting the passage of electric current through the capacitor segment to the RF interface.

13. The RF jumper cable of claim 12, wherein the insulator comprises an organic dielectric.

14. The RF jumper cable of claim 12, wherein the insulator comprises a ceramic material.

15. The RF jumper cable of claim 12, further comprising a weatherproofing boot, concentric to the coaxial cable and configured to slide over the coaxial RF jumper cable to cover the capacitor segment.

16. The RF jumper cable of claim 12, wherein the inner pin comprises a socket portion that engages the inner conductor of the coaxial cable.

17. The RF jumper cable of claim 12, further comprising an air gap between the outer pin and the conductive outer body.

18. The RF jumper cable of claim 12, wherein the inner and outer pins define an overlapping region, and wherein the overlapping region is between about 0.75 inches to about 1.5 inches in length.

* * * * *